US011077358B2

(12) United States Patent
Muñoz Turowiecki

(10) Patent No.: US 11,077,358 B2
(45) Date of Patent: Aug. 3, 2021

(54) CORNER MARKERS

(71) Applicant: Victor A. Muñoz Turowiecki, Guaynabo, PR (US)

(72) Inventor: Victor A. Muñoz Turowiecki, Guaynabo, PR (US)

( * ) Notice: Subject to any disclaimer, the term of this patent is extended or adjusted under 35 U.S.C. 154(b) by 0 days.

(21) Appl. No.: 15/058,686

(22) Filed: Mar. 2, 2016

(65) Prior Publication Data

US 2016/0256768 A1 Sep. 8, 2016

Related U.S. Application Data

(60) Provisional application No. 62/127,143, filed on Mar. 2, 2015.

(51) Int. Cl.
*A63C 19/06* (2006.01)

(52) U.S. Cl.
CPC ..... *A63C 19/065* (2013.01)

(58) Field of Classification Search
CPC ..... A63B 2071/0611
USPC ..... 473/474, 490, 467
See application file for complete search history.

(56) References Cited

U.S. PATENT DOCUMENTS

| | | | | | |
|---|---|---|---|---|---|
| 1,037,147 | A * | 8/1912 | Johnson | E04H 13/003 | 473/490 |
| 1,605,662 | A * | 11/1926 | Rowland | A63C 19/065 | 2/265 |
| 3,580,573 | A | 5/1971 | Noonan | | |
| 4,045,022 | A | 8/1977 | Grant | | |
| 4,296,160 | A | 10/1981 | Forlenza | | |
| 4,880,243 | A * | 11/1989 | Raub | A63B 61/00 | 473/490 |
| 5,158,282 | A * | 10/1992 | Winter | A63C 19/065 | 473/474 |
| 2009/0143174 | A1 * | 6/2009 | Brandt | A63B 71/0605 | 473/467 |

FOREIGN PATENT DOCUMENTS

| | | | | |
|---|---|---|---|---|
| DE | 4237204 A1 * | 5/1993 | ..... | A63C 19/065 |
| DE | 4237204 A1 * | 5/1993 | ..... | A63C 19/065 |

* cited by examiner

*Primary Examiner* — Melba Bumgarner
*Assistant Examiner* — Rayshun K Peng
(74) *Attorney, Agent, or Firm* — Eugenio J. Torres-Oyola; Victor M. Rodriguez-Reyes; Rafael Rodriguez-Muriel

(57) ABSTRACT

A demarcation arrangement for a playing zone directed to a sports involving alternating or dual zones while a game is played. The present disclosure includes a corner-shaped device configured to be located at the corner of a sport zone, wherein said corner-shaped structure comprising a particular indicia and configured to be part of the playing zone while it is visually distinctive from the boundaries lines of said playing zone.

6 Claims, 8 Drawing Sheets

CORNER MARKERS

CROSS-REFERENCE TO RELATED APPLICATION

This nonprovisional application claims priority to U.S. provisional application No. 62/127,143 filed on Mar. 2, 2015.

STATEMENT REGARDING FEDERALLY SPONSORED RESEARCH AND DEVELOPMENT

N/A

BACKGROUND OF THE INVENTION

Field of the Invention

The present disclosure relates to a demarcation arrangement for a playing zone for a sport involving alternating zones while a game is played, more particularly the invention provides a mark arrangement for identify playing zones defining if a ball bounce is in or out of a particular zone.

Discussion of the Background

It is well known that the surfaces, more particularly the playing area of a tennis court, for example, is defined with colored zones divided by white stripes lines, wherein said whites stripes are combined to define each colored zones boundaries. While playing the game some of the white stripes are part of the playing zone, however the continuity or some of the length of the white stripes belongs to the part of the court consider as out of bounce area. Therefore, one of the difficulties encountered with the stripe system and the zones definition is the clear definition of out of bounce zones. For example, while playing tennis, and more particularly at the moment of serving to an opponent, the boundary between the left and right serve-receiving zones at which a ball landing on the center stripe is considered in bounds for both zones. The problem with the white center stripe is that one of the distal ends is not clearly separated between the playing zone and the out of bounce zone. Therefore, boundary lines marked with a stripe, for example in tennis, make harder judging the exact point of impact by eye, more particularly at the corners, by the presence of the stripe. Approximately 50% of the plays wherein the ball bounce at the part of the stripes which are considered in bounds for both zones during a regular game are called erroneously due to problems in judges' perception.

Some sophisticated devices, such as cameras, are used for defining if a ball bounce is in or out of a particular zone. For example, U.S. Pat. No. 5,059,944 discloses an optical system for detecting and signaling a ball out-of-bounds condition on a tennis court. The sensor units are configured around the tennis court in sets of units referred to as optical lattices. Each optical lattice provides intersecting light beams allowing for continuity in court coverage when a player disables a timed plane. An out-of-bounds ball is signaled by an audiovisual device. However, the uses of optical sensors, such as cameras, are complex and expensive. The changes on the court are countless when adding optical sensors to the court.

On another hand, U.S. Pat. No. 4,045,022 discloses a tennis court wherein the different playing zones are distinguished by colors instead of white stripes. The main disadvantage of such disclosure is that the colored playing zones would be less wide than a regular tennis court. This because in a playing zone defined by a white stripe the players may use the outer corner of said white stripe, that usually have a dimension of 2 inches by 2 inches, as an in-bound for the zone. In contrast, in a playing zone defined by color the white stripe is erased and the colored playing zones are expanded one inch to the right and one inch to the left. In that case, the playing zone for serving the ball will be smaller because the player cannot use the outer corner of the white stripe.

Therefore there is a need of improving tennis court boundaries, more particularly the corners, for assisting the line judges for judging the exact point of impact by eye during the games without the need of expensive devices. The present invention could further be used in combination with some other optical, cameras or sensor devices.

SUMMARY OF THE INVENTION

In light of the above shortcomings of the current structures available, the present disclose comprises an exemplary embodiment comprising a corner-shaped device locate at the corner of a court, wherein said corner-shaped structure is configured to be visually distinctive from the boundaries lines of the playing zone.

Another object of the present disclosure is to provide a simple structural modification in current tennis courts for zones where the ball is difficult to call by a line judge.

Further, another object of the present disclosure is to provide a non-expensive simple structural modification in current tennis courts for zones.

Yet another object of the present disclosure is to provide a cohesive unit easy to install and/or remove.

In another aspect of the present disclosure is to provide a device with a particular indicia different from the basic court colors in order to distinguish the zones and provide an easy recognition of a boundary.

Another object of the present disclosure is to provide a device that is easy to install, without requiring several court structural changes.

To enable a better understanding of the objectives and features of the present invention, a brief description of the drawing below will be followed with a detailed description of the invention.

BRIEF DESCRIPTION OF THE DRAWINGS

The accompanying drawings, which are incorporated herein, constitute part of the specifications and illustrate the preferred embodiment of the invention

DETAILED DESCRIPTION OF THE INVENTION

Figure 1:
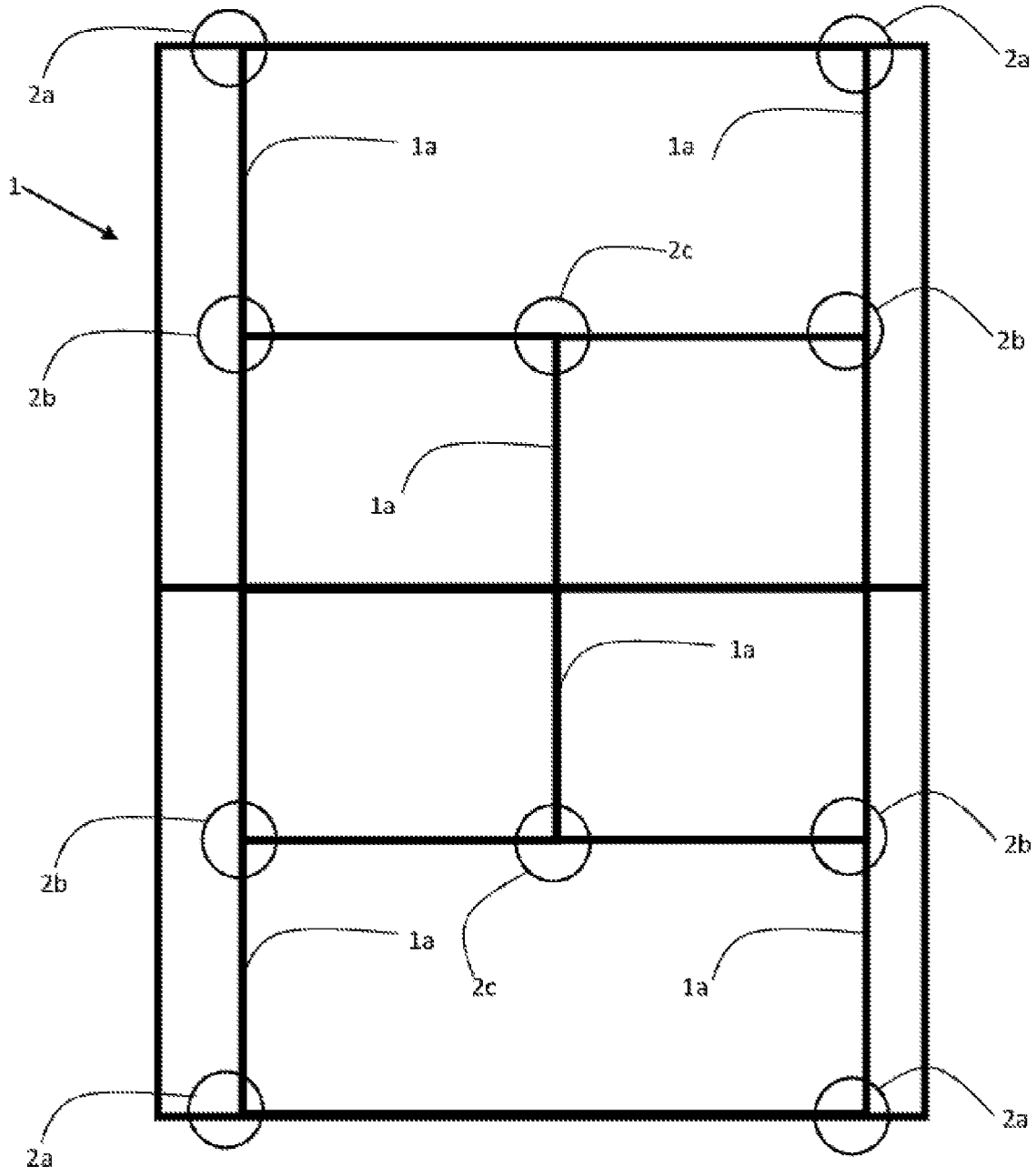
FIG. 1 is a top view of a tennis court identifying the T-junctions.
Figure 2A:
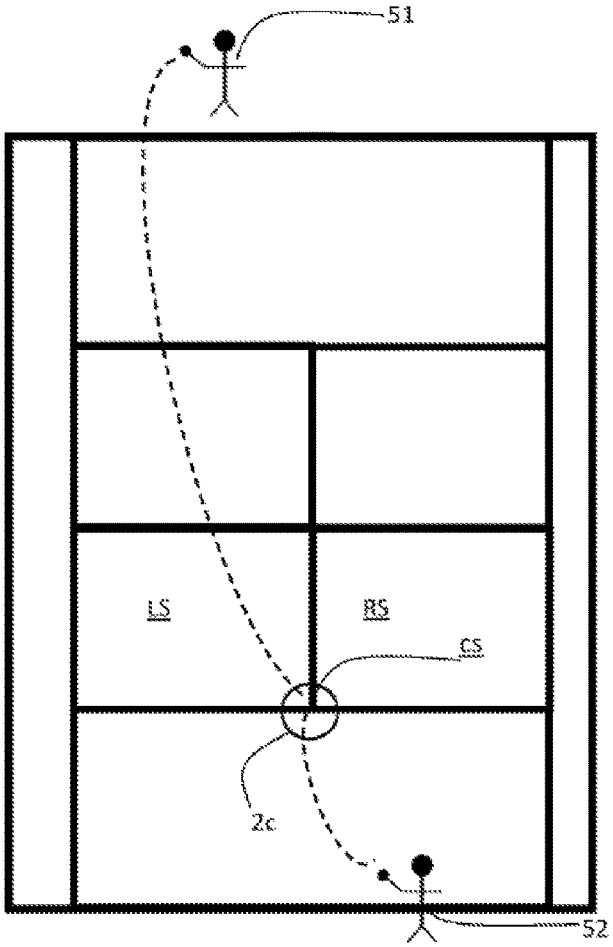
FIG. 2A and FIG. 2B are a top views of a tennis court while playing with exploded view of a T-junction
Figure 2B:
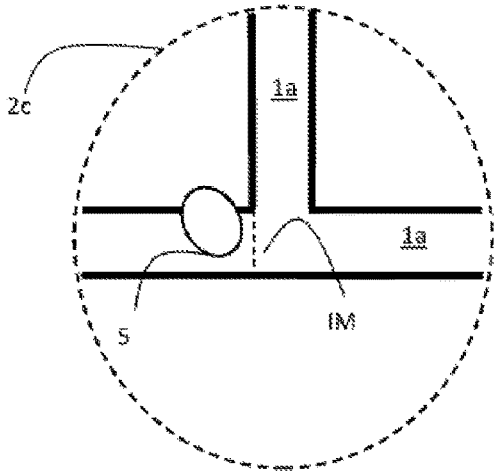

FIG. 1 is directed to and exemplary playing ground 1, such as a tennis court, wherein said tennis court comprises pavement P and white strips 1*a*, wherein said white stripes are arranged to define the playing area generating T-junctions 2*a*, 2*b*, 2*c*. As mentioned before, it is well known that the surfaces, more particularly the playing area of tennis courts, are pave with a uniform color/material and the boundaries of the various playing zones are accomplished by stripes 1*a* on the court surface, which usually have a dimension of 2 inches by 2 inches. The pavement, stripes dimensions and boundaries may change depending on particular times of the game. Further the inbound zone, more particularly while serving, change depending on the side a player is serving. For example, as shown in FIG. 2A, one of the various playing zones defined by using the white stripe system of zone definition, is the boundary between the left serve-receiving zone LS and right serve-receiving zone RS at which a ball landing on the center stripe CS is considered in bounds for both zones. However, when the ball 5 lands on a section close to the T-junctions 2*c*, as shown in FIG. 2B, more particularly the T-junction at the center stripe CS it is extremely difficult to determine if it was out or in of the playing zone due to the proximity to the continuous stripe segment. Furthermore, the segment is not defined by a line. The exploded view of T-junction 2C at the court center present difficulties of distinguishing the in zone (limited by an imaginary line IM) at the right serve-receiving zone RS when a first player 51 serves to a second player 52.

Figure 3:
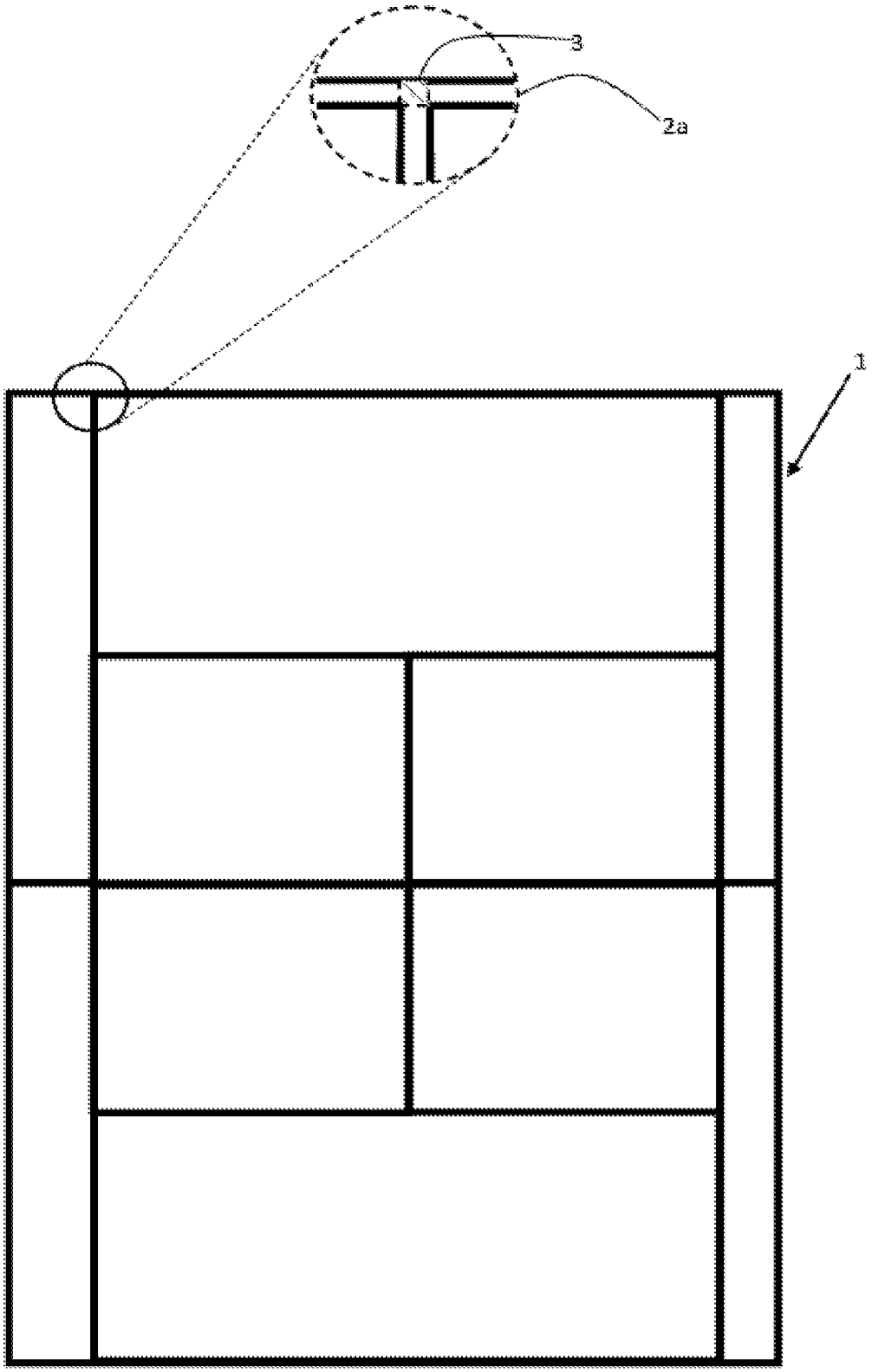
FIG. 3 is a top view of a first exemplary structure of a tennis court with exploded view of the T-junctions.

FIG. 3 is directed to a first exemplary embodiment wherein a T-intermission 3 comprising a third indicia, such as a different material visually different from the color used for the white stripes and of the pavement of the court, is located at the intersection of at least two white strips in T-junctions 2*a*, 2*b* and 2*c*. In this manner, it will be very easy to determine if the ball bounced in the in zone area. No imaginary line IM has to be inferred to make the judgment.

Figure 4:
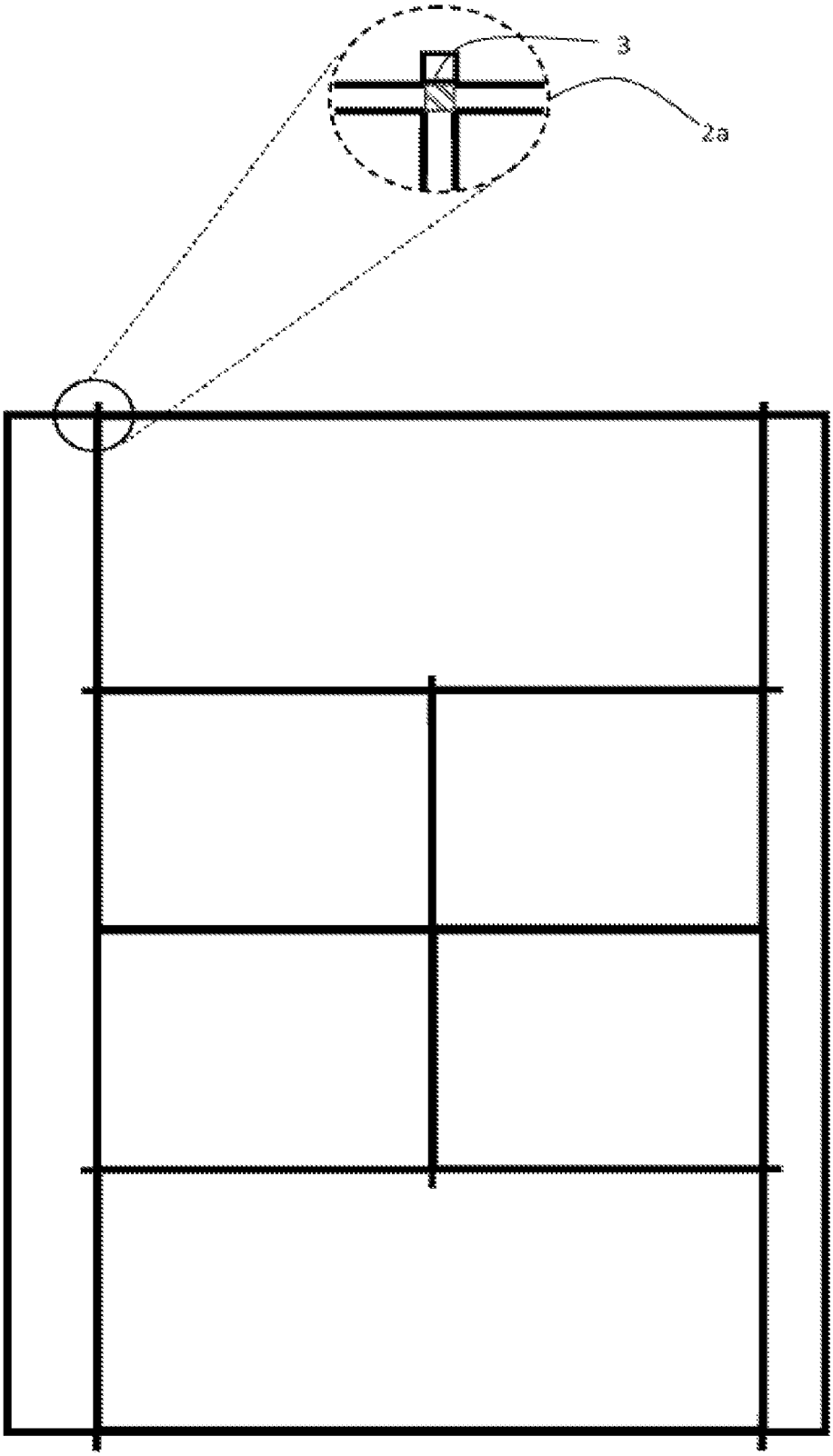
FIG. 4 is a top view of a second exemplary structure of a tennis court with exploded view of the T-junctions.

FIG. 4 is directed to a second exemplary embodiment for the present disclosure explained in more detail below. For the second exemplary embodiment the white stripes in the T-junctions 2*a*, 2*b*, 2*c* are extended for about 2 inches and a T-intermission 3 is located at the intersection of at least two white strips in T-junctions 2*a*, 2*b* and 2*c*. In this embodiment, the color of the T-intermission 3 comprises an indicia, such as a different material visually different from the color used for the white stripes but may be the same color and/or material of the pavement of the court. In this manner, this second embodiment comprises only of two colors (the white stripes and the color of the pavement of the court). This in contrast with the first embodiment that comprises at least three different colors (the white strips, the color of the pavement of the court and the color of the indicia).

Figure 5:
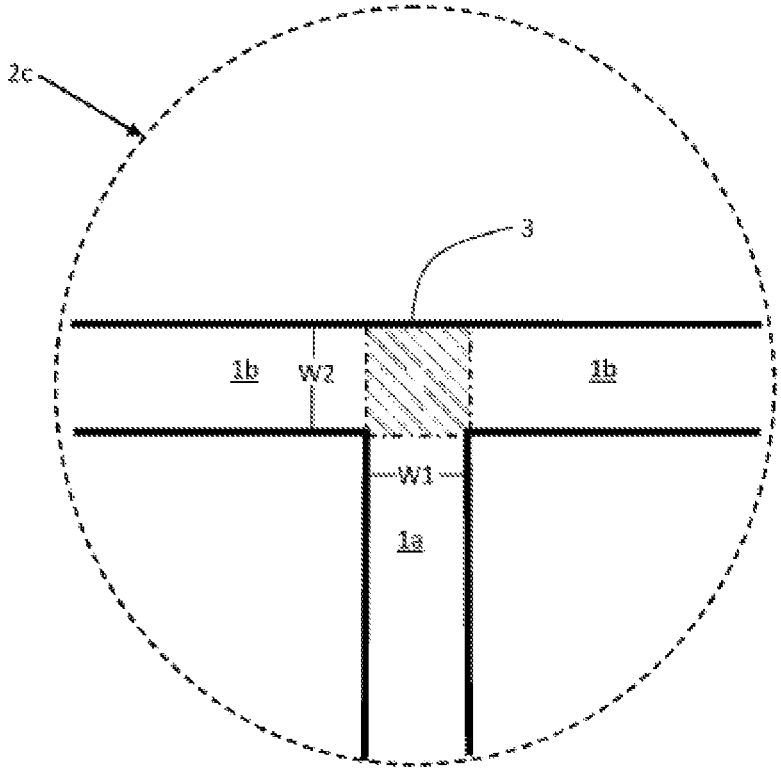
FIG. 5 is an exploded view of the T-junction with the T-intermission of the present disclosure in accordance with the principles of the preferred first embodiment.

FIG. 5 is directed to an exploded view of the T-junction 2*c* with the T-intermission 3 of the present disclosure in accordance with the principles of the preferred first embodiment. The T-intermission 3 is shaped to simulate the corner of a playing zone. The dimension of the T-intermission 3 depends on the white stripe 1*a*,1*b* dimensions, for example the first width W1 of a first white stripe 1*a* defines at least one side of the T-intermission 3 while a second width W2 of a second white stipe 1*b* defines at least another side of the T-intermission 3. The T-intermission 3 comprises particular indicia, wherein said particular indicia is distinctive from the stripe segment indicia and of the court indicia. For example, in a tennis court configured of mainly green pavement with white stripes, T-intermission 3 could be made with a color such as orange, gold, blue or red, amongst others. The difference in visual perception assist the player, line judge and game spectators to distinguish easily if a ball 5 hits the T-intermission 3, in zone or out zone.

Figure 6:
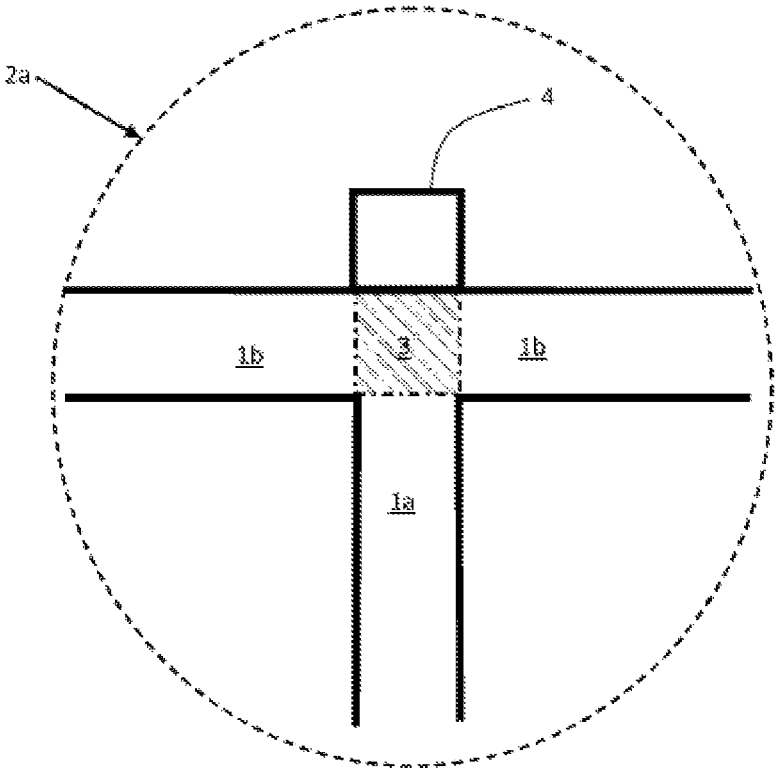
FIG. 6 is an exploded view of the T-junction with the T-intermission of the present disclosure in accordance with the principles of the preferred second embodiment.

FIG. 6 is directed to an exploded view of the T-junction with the T-intermission of the present disclosure in accordance with the principles of the preferred second embodiment as shown in FIG. 4. The preferred second embodiment comprises a T-Mark 4. The T-Mark 4 is configured by extending the white stripe about 2 inches from the zone boundaries in T-junctions 2*a*, 2*b* and 2*c*.

For example, in FIG. 6 the T-Mark 4 at T-junction 2*a* is configured by extending the transversal first white stripe 1*a* about 2 inches from the zone boundaries of the intersection with a second white stripe 1*b*. With this arrangement, the T-intermission 3 is provided. The color of the indicia of the T-intermission 3 must be different from the color of the white stripe but may be the same color of the pavement of the court. For example, in a tennis court configured of mainly green pavement with white stripes, T-intermission 3 could be made with a green color. The difference in visual perception in the T-intermission 3 assist the player, line judge and game spectators to distinguish easily if a ball 5 hits the T-intermission 3, in zone or out zone.

Figure 7A:
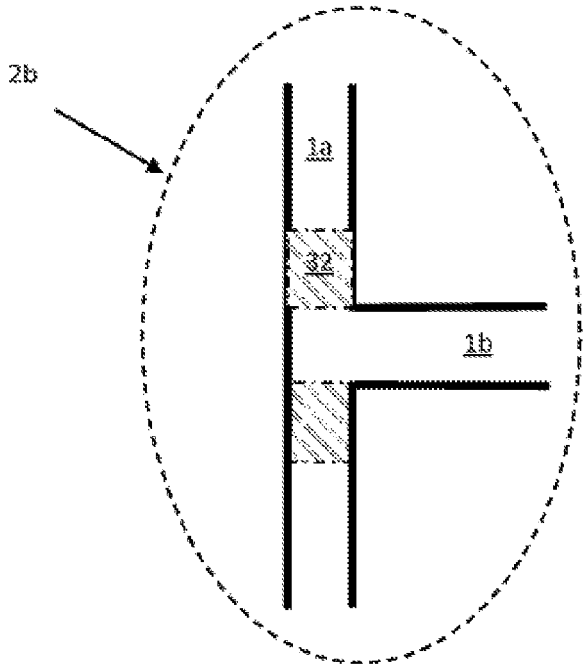
FIGS. 7A and 7B are an exploded view of the T-junction with the T-intermission of the present disclosure in accordance with the principles of the preferred third embodiment.
Figure 7B:
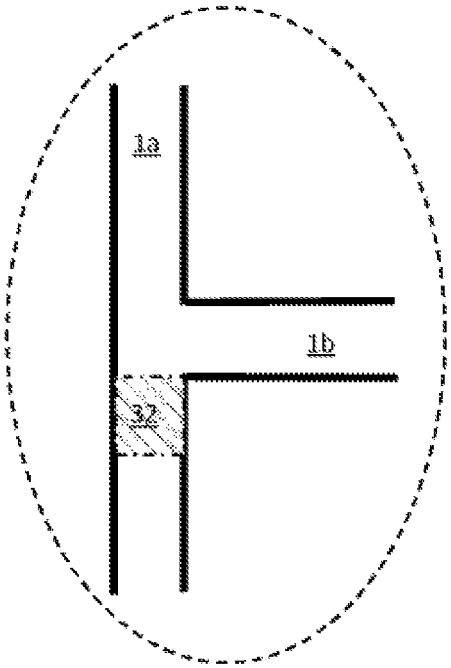

FIGS. 7A and 7B are directed to an exploded view of the T-junction 2*b* with the T-intermission 3 of the present disclosure in accordance with the principles of the preferred third embodiment. The T-intermission 32 is configured to simulate part of the first white stripe 1*a* and is not located at the intersection of the first white stripe 1*a* and second white stripe 1*b*. The dimension of the T-intermission 32 depends on the first white stripe 1*a* dimensions, for example the first width W1 of a first white stripe 1*a* defines at least one side of the T-intermission 32. The T-intermission 32 comprises particular indicia, wherein said particular indicia is distinctive from the first with stripe segment indicia and/or the court indicia but the indicia may be as the same color of the pavement of the court. As in the previous embodiments, the difference in visual perception due to the use of the T-intermission 32 assist the player, line judge and game spectators to distinguish easily if a ball 5 hits the T-intermission 32, in zone or out zone.

Figure 8A:
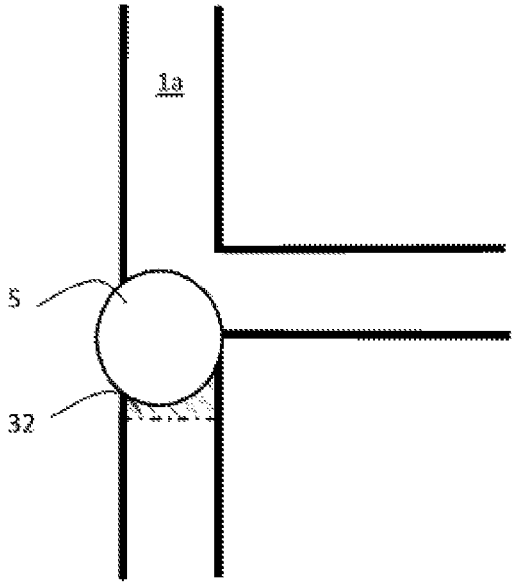
FIGS. 8A-8C are exploded views of the T-junction with the T-intermission while the ball is hitting floor in accordance with the principles of the preferred first embodiment, second embodiment and third embodiment.
Figure 8B:
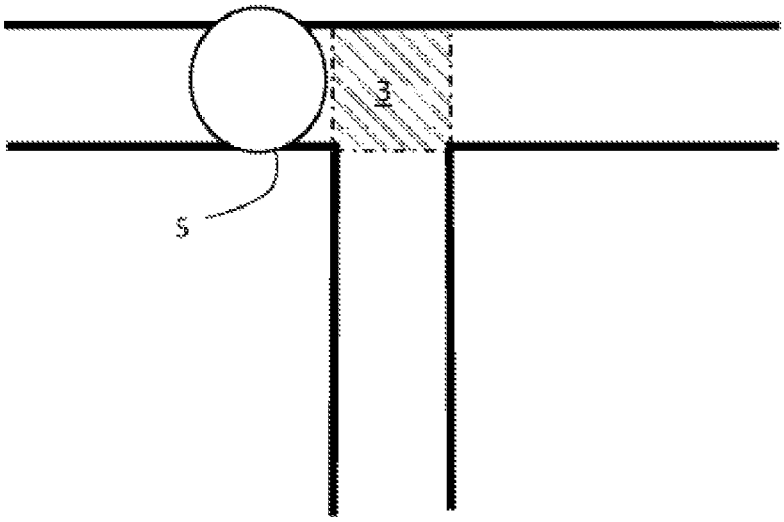
Figure 8C:
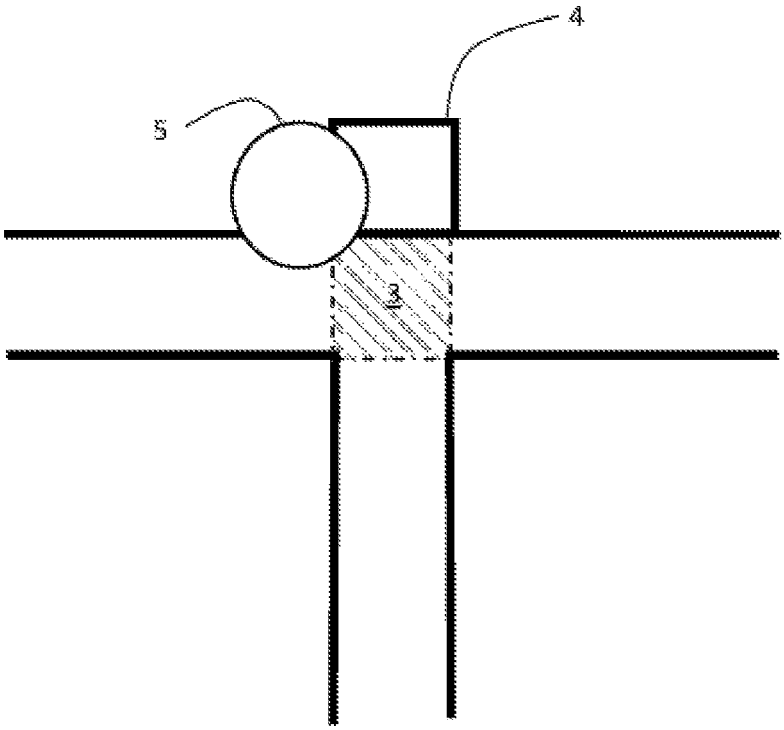

FIGS. 8A through 8C are exploded views of the different embodiments while the ball 5 is hitting floor in accordance with the principles of the preferred disclosure. As mentioned before, the corner, such as the corner of the center stripe is considered in bounds for both zones. FIG. 8A discloses the third embodiment wherein the T-intermission 32 assists to define the inbound boundaries. FIG. 8B discloses the first embodiment the T-intermission 3 and FIG. 8C is directed to a court comprising the T-mark 4, wherein both embodiments are configured to visually be distinctive from the boundaries lines of the playing zone assisting the judgment to determine is a ball 5 is in or out.

The material of the indicia of T-intermission 3 of the present disclosure may vary depending of the material of the surface of the tennis court. It is preferred to use the same material for the indicia of the T-intermission 3 and the surface of the tennis court. Some of these materials are: acrylic, asphalt, or plastic. Preferably the material of the indicia of T-intermission 3 is rigid and attached to the surface and will not move or be deformed if the ball hits it or a player steps on it.

Figure 9A:
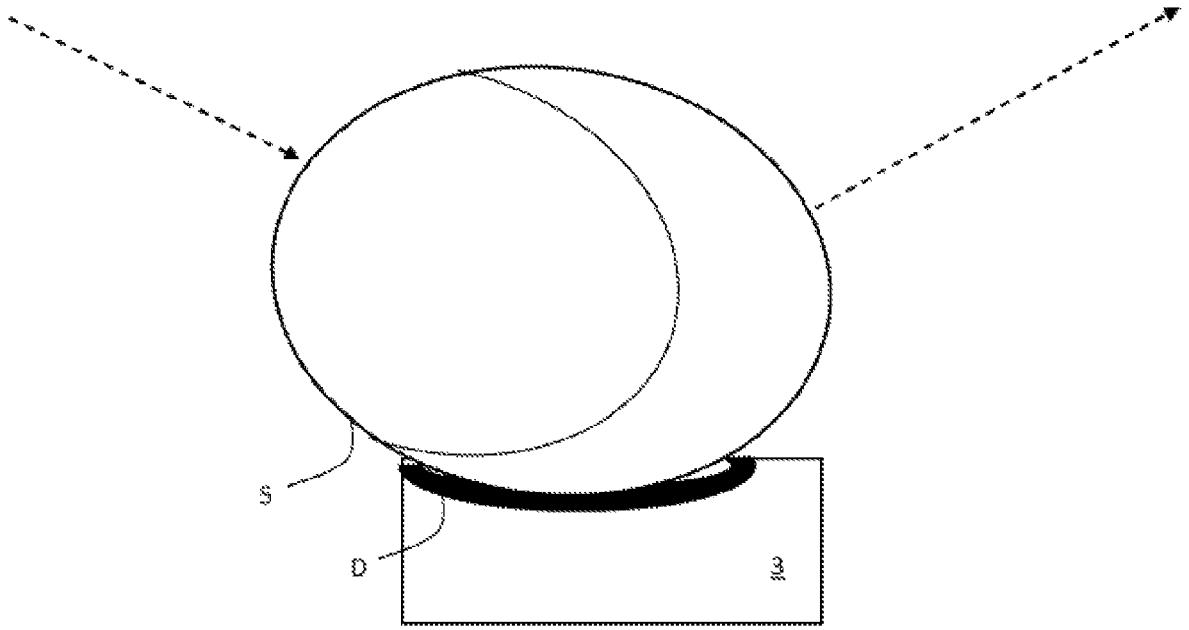
FIGS. 9A-9B are view of the deformable T-intermission being hit by the ball in accordance with the principles of the preferred first embodiment.
Figure 9B:
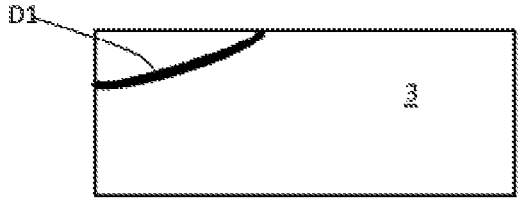

Further a T-intermission 3 with deformation properties and resilient properties may be used to distinguish the boundaries lines of a plying zone. As shown in FIGS. 9A and 9B a deformable T-intermission 3 which is hit by the ball 5 is deformed in accordance with the principles of the present embodiment. The use of a resilient material with deformation properties assists the line judge to double check if the T-intermission 3 was hit by the ball 5.

In summary of the previous sections, the disclosure presented here is structurally innovative, presents advantages not available at the moment with existing courts, complies with all new patent application requirements and is hereby lawfully submitted to the patent bureau for review and the granting of the commensurate patent rights.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patentable distinguish any amended claims from any applied prior art.

What is claimed is:

1. A tennis court having distinguished markers, comprising:

a first surface comprising a first material;

a plurality of vertical lines and horizontal lines comprising a second surface;

wherein the second surface comprises a second material; wherein each line in the plurality of vertical lines and horizontal lines has a width and a length;

wherein a first set of the plurality of vertical lines and horizontal lines outlines a rectangular perimeter that sets the limit of the tennis court;

wherein the first set of the plurality of vertical lines outlining the rectangular perimeter includes two parallel doubles sidelines, and the first set of horizontal lines outlining the rectangular perimeter includes two parallel baselines;

wherein a second set of the plurality of vertical lines and horizontal lines is located within the rectangular perimeter and is arranged to define at least two identical halves of the tennis court, each half comprising two parallel singles sidelines that intersect with each parallel baseline, a service line that intersects with each parallel singles sideline, and a center service line that intersects with the service line of each half;

wherein the intersection between the two parallel singles sidelines with each parallel baseline includes a section of each parallel singles sideline that perpendicularly crosses the corresponding parallel baseline beyond the width of each parallel baseline, thus forming two t-junctions on each parallel baseline;

wherein the intersection between the two parallel singles sidelines with each parallel baseline includes an indicia having a width equivalent to the width of the corresponding singles sidelines and having a length equivalent to the width of the corresponding baseline;

wherein the intersection between the service line of each half with each parallel singles sideline includes a section of the service line that perpendicularly crosses the corresponding parallel singles sideline beyond the width of the corresponding parallel singles sideline, thus forming two t-junctions on each parallel singles sideline;

wherein the intersection between the service line with each parallel singles sideline includes an indicia having a width equivalent to the width of the service line and having a length equivalent to the width of the corresponding parallel singles sideline;

wherein the intersection between the center service line with the service line of each half includes a section of the center service line that perpendicularly crosses each service line beyond the width of the corresponding service line, thus forming a t-junction on the corresponding service line;

wherein the intersection between the center service line with the service line of each half includes an indicia having a width equivalent to the width of the center service line and having a length equivalent to the width of the service line;

wherein each indicia comprises the first material of the first surface;

wherein each section comprises the second material of the second surface;

and wherein the first surface and the second surface are visually different from each other.

2. The tennis court having distinguished markers of claim 1, wherein the first material is selected from the group consisting of acrylic, asphalt, and plastic.

3. The tennis court having distinguished markers of claim 1, wherein the second material is selected from the group consisting of acrylic, asphalt, and plastic.

4. The tennis court having distinguished markers of claim 1, wherein the section of each parallel inner sideline that extends beyond the limit of the rectangular perimeter perpendicularly crossing each baseline, extends by at least 1 inch.

5. The tennis court having distinguished markers of claim 1, wherein the section of the service line that perpendicularly crosses each parallel singles sideline, extends by at least 1 inch.

6. The tennis court having distinguished markers of claim 1, wherein the section of the center service line that perpendicularly crosses each service line, extends by at least 1 inch.

* * * * *